United States Patent [19]

Wolfe

[11] 4,080,149

[45] Mar. 21, 1978

[54] PULSE COMBUSTION CONTROL SYSTEM

[75] Inventor: Denis G. Wolfe, Santa Ana, Calif.

[73] Assignee: Robertshaw Controls Company, Richmond, Va.

[21] Appl. No.: 672,796

[22] Filed: Apr. 1, 1976

[51] Int. Cl.[2] ..... F24J 3/02

[52] U.S. Cl. ..... 431/1; 431/19; 236/1 H

[58] Field of Search ..... 431/1, 12, 78, 22, 19, 431/15, 16, 68, 69, 20; 302/26; 138/45; 137/624.14; 239/99, 101; 116/114 PV, 65, 22 A; 236/80 R, 1 H, 15 R; 110/28 R

[56] References Cited

U.S. PATENT DOCUMENTS

| | | | |
|---|---|---|---|
| 2,329,636 | 9/1943 | McGrath | 431/1 |
| 2,703,071 | 3/1955 | South | 200/83 N |
| 2,907,382 | 10/1959 | McIlvaine | 431/1 |
| 2,950,592 | 8/1960 | Frank | 431/1 X |
| 3,005,067 | 10/1961 | Liebold et al. | 200/83 N |
| 3,101,768 | 8/1963 | Curtis | 431/1 |
| 3,123,027 | 3/1964 | Livingston | 431/12 X |
| 3,146,821 | 9/1964 | Wuetig | 431/19 X |
| 3,169,570 | 2/1965 | Haag et al. | 431/1 |
| 3,190,340 | 6/1965 | Fritsch | 431/1 |
| 3,202,198 | 8/1965 | Haag et al. | 431/1 |
| 3,276,505 | 10/1966 | Huber et al. | 431/1 |
| 3,819,318 | 6/1974 | Pearson | 431/1 |
| 3,897,195 | 7/1975 | Finch | 431/1 |
| 4,030,874 | 6/1977 | Vollerin | 431/19 |

*Primary Examiner*—Edward G. Favors
*Assistant Examiner*—Larry Jones
*Attorney, Agent, or Firm*—Fulwider, Patton, Rieber, Lee & Utecht

[57] ABSTRACT

There is disclosed a safety control for a pulse combustion system. In a pulse combustion process, a combustible fuel and air are introduced into a combustion chamber through check valves in pulses and ignite to generate an alternating sinusoidal pressure wave. The control system of the invention comprises rectifying the sinusoidal pressure wave to obtain therefrom a differential pressure signal and applying the pressure signal to a control circuit to position a valve in the combustible fuel supply. Any interruption in combustion within the chamber causes a cessation of the differential pressure signal and closes the control valve. The apparatus of the invention includes, as the rectification facility, a dynamic check valve having a funnel member which is longitudinally disposed in a conduit communicating between the pulse combustion chamber and a pressure responsive transducer, the latter being operatively connected to maintain the fuel supply valve open during combustion and to close the fuel supply valve upon failure of combustion within the chamber.

10 Claims, 3 Drawing Figures

84
80
82
119
116
118
58
28
42
50
32
16
14
30
46
44
48
34
52
54
38
21
24
18
40
10
12
100
102
36
22
56
26
108
114
110
70
72
74
104
96
98
106
78
108
76
90
92
94
86
88
60
64
66
62
68

PULSE COMBUSTION CONTROL SYSTEM

BACKGROUND OF THE INVENTION

1. Field of the Invention

This invention relates to pulse combustion and, in particular, to a safety control system for pulse combustion.

2. Brief Statement of the Prior Art

Pulse combustion, although known for some time, has not been adapted to any significant extent for heating plants. Pulse combustion, however, offers many advantages including the potential of high efficiency, an advantage of increasing value in a society faced with dwindling energy sources. Other advantages of the pulse combustion include its adaptability to many combustible fuels, compactness and high thermal capacity. Many of the problems associated with pulse combustion, such as high operational noise levels, have been obviated; the noise level having been reduced to acceptable levels by mufflers and the like. Improved design of the check valves for the combustible fuel and air supply have also greatly extended the operational life of these members and increased the reliability of the combustion units.

One difficulty which, heretofore, has not been obviated is a simple method and apparatus for a fail-safe emergency shut off of the supply of combustible fuel to the burner in the event of failure of combustion within the combustion chamber.

BRIEF STATEMENT OF THE INVENTION

This invention comprises a facile control system for the fail-safe operation of pulse combustion. The control system of the invention comprises rectification of the alternating sinusoidal pressure wave present within the pulse combustion chamber during its normal operation to derive a differential pressure signal that is indicative of combustion within the chamber. This differential pressure signal can be applied to a pressure transducer to generate a control signal which is applied to a valve in the combustible fuel supply to the system whereby the combustible fuel supply is discontinued upon failure of combustion within the pulse combustion chamber.

The method of this invention, therefore, comprises rectification of the alternating sinusoidal pressure wave within the pulse combustion chamber and application of the resultant differential pressure to control means in the combustible fuel supply. The apparatus of the invention comprises dynamic check valve means in the form of a funnel member longitudinally disposed in a conduit communicating between the combustion chamber and a pressure-responsive transducer. The dynamic check valve is operative to provide a rectified differential pressure which is reflective of the combustion occurring within the pulse combustion chamber. The fuel supply to the pulse combustion chamber includes a control valve that is actuated in response to the differential pressure signal.

BRIEF DESCRIPTION OF THE DRAWINGS

The invention will be described with reference to the figures, of which.

DESCRIPTION OF THE PREFERRED EMBODIMENT

Figure 1:
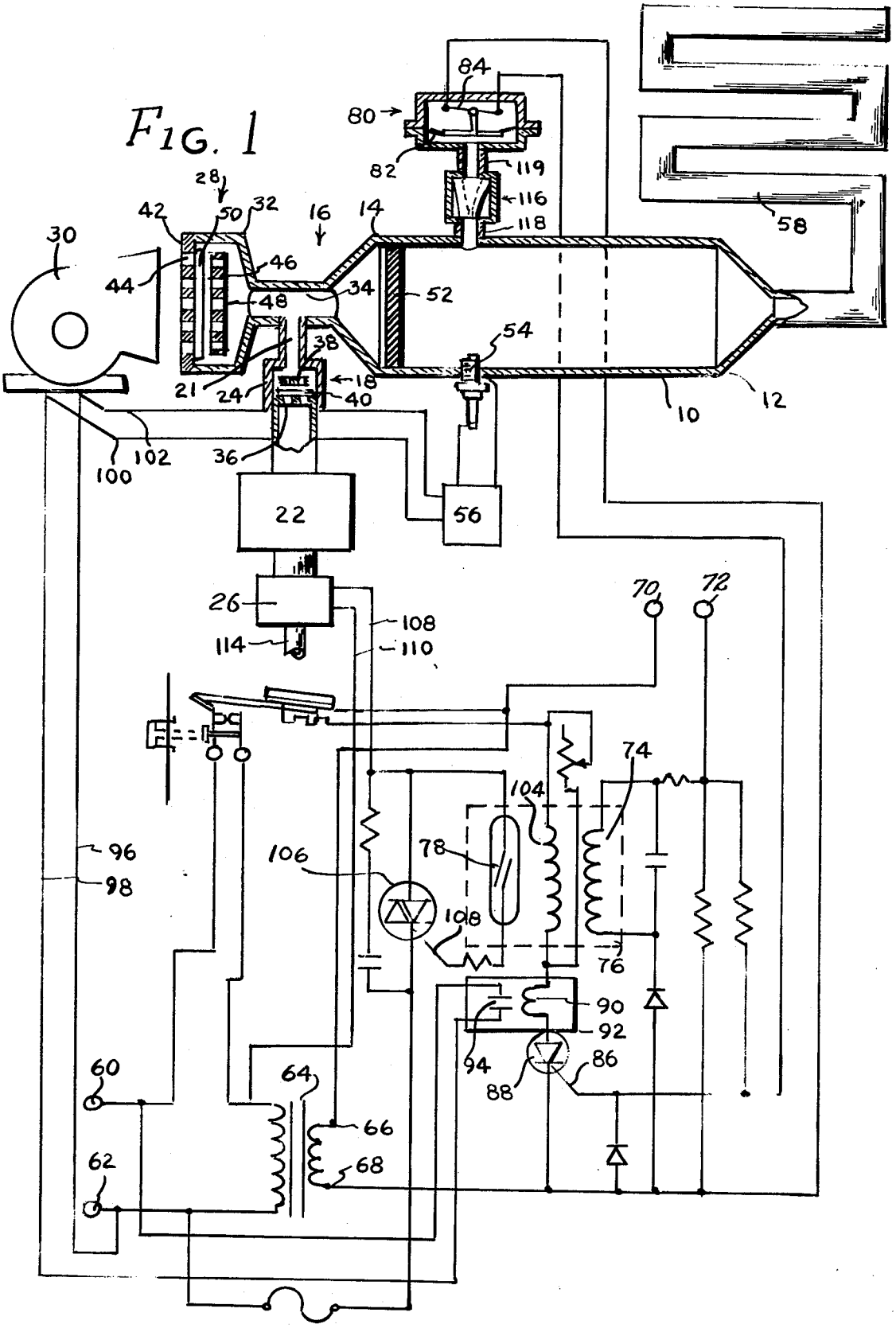
FIG. 1 illustrates a pulse combustion system employing the invention.

Referring now to FIG. 1, the pulse combustion system is illustrated as including a pulse combustion chamber 10 in the form of a generally elongated vessel having a discharge end 12 and bearing, at its opposite end 14, combustible fuel and oxygen-containing gas supply means generally indicated at 16. The combustible fuel supply 18 includes conduit 21 communicating with a source of a combustible fuel such as accumulator vessel 22 through a combustible fuel check valve 24. The combustible fuel, which can be any suitable material such as natural gas, gasoline, kerosene, benzene, etc., is supplied to accumulator 22 through a control valve 26.

The source of the oxygen-containing gas, which can be any gas containing molecular oxygen such as air and the like, is generally indicated at 28 and comprises a blower 30 which receives ambient air and discharges the air into the air check valve 32, communicating with conduit 34 in the fuel and air supply system 16.

The respective check valves for the air and combustible fuel supply are, typically, flapper valves. The gas flapper valve comprises a face plate 36 bearing a plurality of apertures and supporting a companion backer plate 38 of similar construction and mounted at a spaced-apart downstream position from the face plate 36. A gas flapper member 40 is positioned between the face plate 36 and backer plate 38. The flapper member 40 can be constructed of spring steel and coated with an elastomer. The apertures through face plate 36 discharge into conduit 21 that communicates with conduit 34 of the fuel and air supply system 16.

The air check valve is of similar construction. The air valve is in the form of a rear plate 42 bearing a plurality of apertures 44 communicating with the outside air. The interior of the check valve structure includes the air flapper backer plate 46 that is positioned at a spaced-apart location from the air valve plate 42 and that also has a plurality of apertures 48 for flow of air therethrough. The air flapper member 50 which is in the form of a flexible sheet material, typically spring steel coated with an elastomer, is mounted between the air valve plate 42 and backer plate 46.

A porous or permeable plate 52 is provided in the combustion chamber downstream of the fuel and air introduction system 16. The permeable plate 52 can be of any suitable construction, e.g., of gas-permeable sintered metal, ceramics, and the like. This gas-permeable plate 52 functions as a flame trap, impeding the propagation of combustion from the combustion chamber 10 towards the fuel and air supply system 16. This is achieved by the multiple passageways through the permeable plate 52 that increase the velocity of the gases flowing therethrough to a value exceeding the linear velocity of the advancing flame front.

The pulse combustion system includes facilities for initiating combustion within the chamber 10. The facilities include the air blower 30 which is employed usually only for initiation of combustion and sparking means such as spark plug 54 that is in electrical communication with spark generator 56. Combustion is initiated within the chamber 10 by discharging air from blower 30 into air intake valve 32, and supplying a combustible gas through valve 26 into chamber 10 where the resultant combustible mixture is ignited by spark plug 54.

The ignition of the combustible mixture generates a combustion wave within the chamber that propagates toward the discharge port 12 of the chamber. The advance of this combustion front creates a reduced pressure in the chamber behind the advancing front, inducing air flow through check valve 32 and gas flow through gas check valve 24. Once the combustion process has been initiated by ignition of the combustible mixture, the combustion is self-propagating and the spark generator 56 and blower 30 can be removed from service.

The system also includes suitable heat exchanger facilities 58 generally in the form of an elongated tube, heat exchanger bundle, and the like where the hot combustion gases are passed in indirect heat exchange with another fluid, e.g., ambient air in space heaters, water in water heaters, etc.

The electrical control circuit for the system can be that of a conventional burner control system modified to incorporate the fail-safe control means of this invention. In this circuit, the line voltage is applied to the circuit through terminals 60 and 62 to a transformer 64 to obtain the reduced voltage at the transformer secondary terminals 66 and 68 which is employed in the control circuit. The thermostat switch is applied across input terminals 70 and 72 and when the circuit is completed through these terminals, current flows through coil 74 of the reed switch assembly 76, tending to close the contact 78 of the switch.

The present invention includes, in the control means, a pressure sensitive transducer generally indicated at 80 which is in the form of a vacuum switch having a fluid-tight housing with a diaphragm 82 attached to a switch lever 84 and spring biased to position the switch lever 84 into a normally open position. The application of a vacuum to the under surface of the diaphragm overcomes the spring bias and moves lever 84 into the illustrated closed position. When the control circuit is activated to initiate combustion, the vacuum switch 80 is open and voltage is applied to gate 86 of the SCR 88 permitting current flow through the coil 90 of normally open relay 92. Closure of the relay contacts 94 of relay 92 applies the line voltage to blower 30 through conducting leads 96 and 98. Line voltage is also applied to spark generator 56 through conducting leads 100 and 102 whereby the spark plug 54 is ignited. The gating of the SCR into a conducting mode also causes sufficient current flow through coil 104 which together with coil 74 closes the contacts of reed switch 78 and applies the circuit voltage to the gate 108 of triac 106, activating the triac to a conducting mode and applying the source voltage through conducting leads 108 and 110 to the solenoid valve 26 in the combustible gas supply line 114.

The resultant supply of combustible gas to the gas combustion chamber 10 produces an explosive mixture within this chamber that is ignited by the spark plug means 54, creating a pressure wave that propagates along the length of the chamber and sets up a momentary subatmospheric pressure in the induction system 16, resulting in the formation of a following wave of combustible mixture that is ignited by the spark plug means 54. Once the sequence of combustion wave ignition has been initiated within combustion chamber 10, the combustion is self-propagating and blower 30 with spark generator 56 can be disconnected from the operation. This is accomplished by the control system of the invention.

The invention as applied to the combustion system thus described includes a dynamic check valve means 116 in conduit 118 that communicates between the pulse combustion chamber and the pressure transducer 80. This dynamic check valve functions to rectify the alternating sinusoidal pressure wave within chamber 10 into a pressure signal that is of slightly subatmospheric pressure, e,g., from 0.2 to about 2 psi below atmospheric pressure. The rectified pressure signal is applied to the underside of diaphragm 82 of pressure transducer 80 and is sufficient to overcome the resilient bias of the spring of pressure transducer 80, moving lever 84 to close the contacts of the electrical switch. The closure of the contacts of the switch removes the voltage applied to the gate 86 of SCR 88, turning the SCR into a nonconducting mode and ceasing the current flow through coil 104 of the reed switch unit 76 and through coil 90 of the normally open relay 92. This permits the contacts of relay 92 to open, interrupting the voltage supply to blower 30 and spark generator 56.

The continued current flow through coil 74 is sufficient to maintain the contacts 78 of the reed switch unit 76 closed and triac 106 in its gated, conducting mode for the continued application of line voltage to the solenoid valve 112 in the gas supply.

The opening of the switch of the thermostat and breaking of continuity between terminals 70 and 72 removes the applied voltage from coil 74, thereby permitting contact 78 to open, removing the gating voltage from triac 106, and interrupting the voltage supply to the gas solenoid valve 26, thereby shutting down the pulse combustion system until a demand is again applied by the thermostat, closing the switch contacts between terminals 70 and 72.

In the event that continuity of combustion is interrupted in the pulse combustion chamber 10 at any time while the combustible gas and the air are supplied thereto, the control system of the invention is operative to sense the failure of combustion and to shut down the combustion system. The failure of combustion in combustion chamber 10 interrupts the alternating sinusoidal pressure wave within this chamber and the chamber pressure becomes atmospheric pressure. The absence of a subatmospheric pressure signal through the dynamic check valve 116 permits the spring of transducer 80 to move lever 84, opening the switch contacts and removing the gating voltage applied to the gate 86 of SCR 88. The current flow through the SCR also passes through the bimetallic switch 120. The switch 120 is operative upon continued current flow through the system to open after the heater 122 has caused thermal deflection of the bimetallic lever 124. This interrupts the current flow through the coil 104 and through the normally open relay 92, opening contacts 94 and closing the solenoid valve 26 in the gas supply line.

Figure 2:
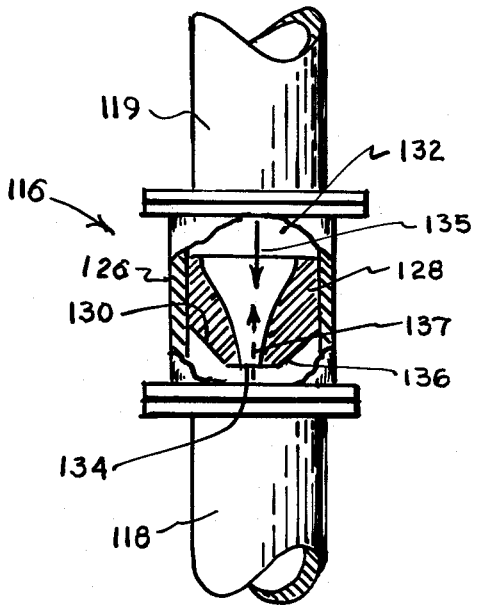
FIG. 2 illustrates the dynamic check valve used in the invention.

Referring now to FIG. 2, the dynamic check valve 116 which serves as the pressure rectifier will be described in greater detail. As here illustrated, the dynamic check valve 116 is within cylindrical housing 126 that is positioned in conduit 118. Cylindrical housing 126 contains a funnel-shaped member 128 that is positioned with its truncated apex 130 oriented in an upstream direction, i.e., towards the pulse combustion chamber 10 shown in FIG. 1. The large diameter base of the funnel member 128 is oriented towards the pressure transducer 80.

The dynamic check valve 116 functions by providing a directional sensitive flow restriction. This is achieved by placing an orifice member in the valve which has discharge coefficients of different value in opposite directions of flow. A simple funnel of a uniform straight taper can be used to provide a greater discharge coefficient, and hence lesser flow resistance, in the direction of convergence of the conical wall of the funnel.

A preferred embodiment is shown in FIG. 2 where the funnel-shaped member 128 has an internal passageway 132 with a gentle curvature approaching the orifice throat 134. The opposite face 136 of the member 128 is sharp edged and can be beveled, as shown, to enhance the difference between the discharge coefficients for flow in opposite directions.

The result of this construction is to provide facile gas flow through the dynamic check valve 116 in the direction of arrowhead line 135 and a greater resistance to air flow in the direction of the broken arrowhead line 137. This results in a net flow of gas in the direction of the arrowhead line 135 when a pulsating pressure is applied to conduit 118.

Figure 3:
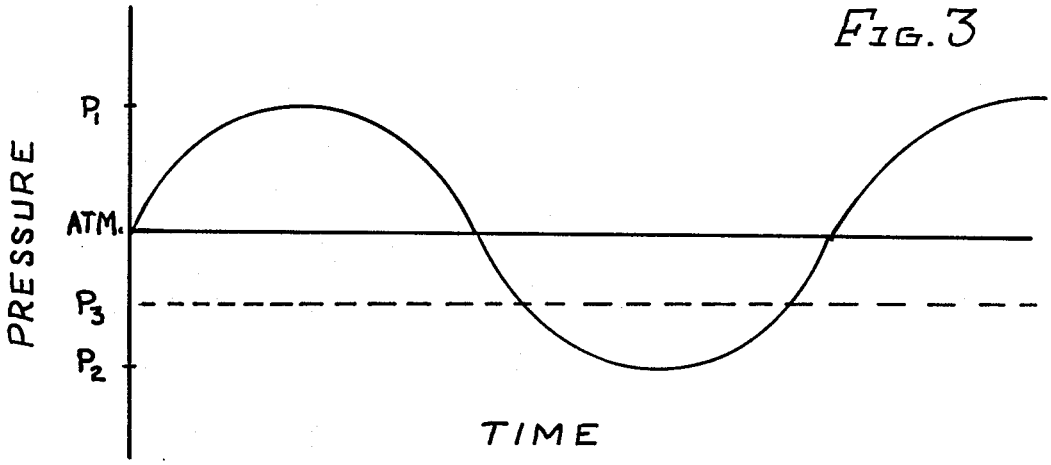
FIG. 3 depicts the alternating pressure wave within the combustion chamber and the rectified signal derived therefrom.

Referring now to FIG. 3, there is illustrated the typical alternating sinusoidal pressure wave that occurs within chamber 10 of a pulse combustion system. As there illustrated, the pressure within the chamber fluctuates between a maximum positive pressure $P_1$ and a minimum subatmospheric pressure $P_2$. Because fluid flows more readily in the funnel direction through the rectifying means, dynamic check valve 116, the pressure developed in conduit 119, which communicates with the pressure transducer 80, will be a rectified pressure $P_3$ shown by broken line 140. This will be a steady subatmospheric pressure when the check valve is oriented in the direction indicated in FIG. 2. Reversal of the check valve will, of course, result in production of a steady, slightly super-atmospheric pressure at conduit 118'. While the check valve 116 could be oriented in either direction to produce a pressure signal, it is preferred to orient the valve in the indicated manner, thereby preventing any net gas flow from combustion chamber 10.

The invention has been described with reference to the illustrated and presently preferred embodiments thereof. It is not intended that the invention be unduly limited by this description of preferred embodiments. Instead, it is intended that the invention be defined by means of steps, and obvious equivalents thereof, set forth in the following claims.

What is claimed is:

1. In a pulse combustion apparatus including a combustion chamber and fuel and air introduction means, including fuel and air check valve means, communicating with one end of said chamber whereby said fuel and air are pulse introduced into said chamber and ignite therein to generate an alternating sinusoidal pressure wave fluctuating about atmospheric pressure within said chamber, the improved control means which comprises:

valve means in said fuel introduction means;

valve actuation means to move said valve between open and closed positions;

pressure sensitive means;

conduit means communicating between said chamber and said pressure sensitive means;

pressure rectification means disposed in said conduit to provide a rectified differential pressure signal from said alternating sinusoidal pressure wave within said chamber;

means to apply said differential pressure signal to said pressure sensitive means; and means operatively connecting said pressure sensitive means with said rectification means to close said valve upon cessation of said rectified differential pressure signal.

2. The pulse combustion apparatus of claim 1 wherein said valve means is an electrically controlled solenoid valve.

3. The pulse combustion apparatus of claim 1 wherein said rectification means comprises a dynamic check valve having a funnel-shaped member oriented in said conduit with its truncated apex directed towards said pulse combustion chamber and operative to develop a steady subatmospheric pressure as said rectified pressure signal.

4. The pulse combustion apparatus of claim 3 including a plurality of said funnel-shaped members in coaxial, closely spaced positions.

5. The pulse combustion apparatus of claim 1 wherein said pressure sensitive means comprises an electrical contact switch member mechanically coupled to a pressure responsive diaphragm of said pressure sensitive means.

6. The pulse combustion apparatus of claim 1 wherein said rectification means comprises flow check valve means operative to provide flow resistance in said conduit means of lesser flow resistance towards said combustion chamber than from said combustion chamber.

7. In a method of pulse combustion wherein a combustible fuel and an oxygen-containing gas are pulse introduced through supply shut off means into a combustion chamber and ignite therein to generate an alternating sinusoidal pressure wave fluctuating about atmospheric pressure within said chamber, the improved method for control of said pulse combustion which comprises:

rectifying said sinusoidal wave to obtain therefrom a steady-state pressure signal;

applying said steady-state signal to a control means to generate a control signal indicative of the continued combustion within the pulse combustion chamber; and applying said control signal to said shut off control to interrupt the introduction of said combustible fuel to said pulse combustion upon interruption of said pressure signal.

8. The method of claim 7 wherein said pressure wave within said combustion zone resonates at a pulsating frequency from 30 to about 120 cycles per second.

9. The method of claim 7 wherein a combustible gas is employed as combustible fuel.

10. The method of claim 7 wherein said sinusoidal wave is rectified to obtain a steady-state subatmospheric pressure signal.

* * * * *